US006997769B2

(12) United States Patent
Saeki

(10) Patent No.: US 6,997,769 B2
(45) Date of Patent: Feb. 14, 2006

(54) PLASMA DISPLAY PANEL MANUFACTURING APPARATUS AND MANUFACTURING METHOD

(75) Inventor: Hiroshi Saeki, Tokyo (JP)

(73) Assignee: Pioneer Corporation, Tokyo (JP)

( * ) Notice: Subject to any disclaimer, the term of this patent is extended or adjusted under 35 U.S.C. 154(b) by 446 days.

(21) Appl. No.: 09/755,696

(22) Filed: Jan. 5, 2001

(65) Prior Publication Data

US 2001/0007805 A1 Jul. 12, 2001

(30) Foreign Application Priority Data

Jan. 7, 2000 (JP) ..... 2000-001842

(51) Int. Cl.
*H01J 9/38* (2006.01)

(52) U.S. Cl. ..... 445/70; 445/24

(58) Field of Classification Search ..... 445/70, 445/25, 40, 41, 42, 43, 44, 71, 24; 313/582, 313/583, 584

See application file for complete search history.

(56) References Cited

U.S. PATENT DOCUMENTS

| | | | | |
|---|---|---|---|---|
| 5,207,607 | A * | 5/1993 | Nagano et al. | 445/25 |
| 5,797,780 | A * | 8/1998 | Peng | 445/25 |
| 5,813,893 | A * | 9/1998 | Robinson | 445/25 |
| 5,846,110 | A * | 12/1998 | Kanagu et al. | 445/25 |
| 5,876,260 | A * | 3/1999 | Pepi et al. | 445/25 |
| 5,938,494 | A * | 8/1999 | Betsui et al. | 445/24 |
| 6,004,181 | A * | 12/1999 | Robinson | 445/70 |
| 6,172,460 | B1 * | 1/2001 | Damen et al. | 313/553 |
| 6,186,722 | B1 * | 2/2001 | Shirai | 414/217 |
| 6,193,811 | B1 * | 2/2001 | Sundarrajan et al. | 134/19 |
| 6,254,449 | B1 * | 7/2001 | Nakanishi et al. | 445/25 |
| 6,257,945 | B1 * | 7/2001 | Nakayama | 445/25 |
| 6,719,516 | B1 * | 4/2004 | Kroeker | 414/217 |

FOREIGN PATENT DOCUMENTS

| | | |
|---|---|---|
| JP | 63-207033 | 8/1988 |
| JP | 2-299130 | 12/1990 |
| JP | 4298944 | 10/1992 |
| JP | 5-48354 | 12/1993 |
| JP | 6-9437 | 3/1994 |
| JP | 6-139935 | 5/1994 |
| JP | 11-204039 | 7/1999 |

* cited by examiner

*Primary Examiner*—Joseph Williams
*Assistant Examiner*—Dalei Dong
(74) *Attorney, Agent, or Firm*—Drinker Biddle & Reath LLP

(57) ABSTRACT

The apparatus for manufacturing a plasma display panel having a first mechanism for supplying a cover member formed by a metal sheet to which low-melting-point glass is applied to a first location within the gas introduction and sealing chamber, a second mechanism provided in the gas introduction and sealing chamber for moving the cover member from the first location to a second location which is over a heating apparatus provided in the gas introduction and sealing chamber, a third mechanism provided in the gas introduction and sealing chamber for performing vacuum exhausting an inside of the plasma display panel and then introducing a luminescent gas into the plasma display panel, and a fourth mechanism provided in the gas introduction and sealing chamber for heating the metal sheet to which the low-melting-point glass is applied by using the heating apparatus, so that the gas introduction port is sealed by the low-melting-point glass.

5 Claims, 3 Drawing Sheets

PLASMA DISPLAY PANEL MANUFACTURING APPARATUS AND MANUFACTURING METHOD

BACKGROUND OF THE INVENTION

1. Field of the Invention

The present invention relates to a plasma display panel manufacturing apparatus, and to a manufacturing method therefor, and more particularly to an apparatus for performing integrated panel sealing, release of exhaust gas, introduction of luminescent gas or discharge gas, and vacuum sealing, and a method of manufacturing a plasma display panel using this apparatus.

2. Related Art

A plasma display panel is generally formed by a front substrate and a rear substrate which have mutually perpendicular opposing electrodes on each of the substrates, a glass tube (hereinafter referred to as an exhaust tube) mounted by low-melting-point glass so as to join a through hole provided beforehand on the rear substrate for the purpose of introducing and exhausting gas, these elements being placed in a sealing furnace so as to melt the low-melting-point glass and form the glass vessel. In addition to release of the exhaust gas via the exhaust tube, the panel is heated to release internal gas. After degassing for a prescribed amount of time in order to achieve a prescribed level of vacuum, filling is done with a gas such as neon (Ne), argon (Ar), or xenon (Xe) or a gas mixture thereof at approximately 53,200 to 79,800 Pa (400 to 600 Torr), which serves as a luminescent gas, after which a gas burner or the like is used to seal the exhaust tube thereby forming a plasma display panel with an exhaust tube.

A second known method is that of combining a rear substrate and a front substrate, and placing the combination inside a vacuum chamber, performing vacuum exhausting and degassing, and subsequent filling with a luminescent gas in the vacuum chamber, and then melting the low-melting-point glass of the peripheral part of the substrate so as to perform sealing thereof. In the case of this method, the structure is one in which there is neither an exhaust tube nor a gas introduction hole in the panel.

A third method that has been proposed is one in which a 10 to 20 mm semichip tube is provided as a gas introduction hole, this semichip tube provided on the substrate being covered by a small chamber, and residual gas within the panel being exhausted via the semichip tube, after which gas sealing is done, a halogen lamp being used to illuminate the semichip tube via a quartz window provided in the small chamber, so as to melt the semichip tube and perform sealing.

In the above-noted methods of manufacturing a plasma display panel of the prior art, however, because many minute separators having a height of 100 to 200 $\mu$m between the front substrate and the rear substrate are provided, and the conductance of the exhaust tube is small, 10 or more hours is required for vacuum exhausting degassing, making the productivity low. Additionally, there is insufficient exhausting and poor purity of the luminescent gas depending upon the lot, this manifesting itself as the problem of a tendency toward variation in the discharge characteristics.

Additionally, because the glass tube (chip tube) remaining after the exhaust tube is removed is extremely fragile, and subject to breakage with even a small shock, not only is it necessary to take extreme care when handling the panel, but also when the plasma display panel is combined with a driving electronic circuit to form a module, it is necessary to mount a protective cap, and to establish a design that avoids interference in electronic components and the printed circuit board.

With regard to the second above-noted manufacturing method of the past, in which there is no exhaust tube, although there is a significant improvement in the exhausting time, residual gas is sealed within the panel when sealing is done, thereby leading to a deterioration of the purity of the luminescent gas. Additionally, amount of costly luminescent gas used is large, causing the problem of high cost.

In the third above-noted manufacturing method of the past, although the problem of the second method is solved, a protruding exhaust tube remains on the panel, thereby requiring the same type of care in handling as with a conventional panel with an exhaust tube.

In Japanese Utility Model (KOKOKU) No. 5-48354, a display apparatus for PDP panel in which a gas inlet hole is sealed by a cover member, is disclosed.

In Japanese Utility Model (KOKOKU) No. 6-9437, a jig for fabricating a display apparatus for PDP panel, is disclosed. In this invention, a mechanism for the purpose of sealing a gas inlet hole is described.

In IDW'97 meeting, "Vacuum process for plasma display panel without exhaust pipe" is reported by Y. Shimamoto et al. This newly developed process is composed of vacuum exhausting, luminescent gas filling and frit sealing steps. However, these inventions do not solve above mentioned drawbacks.

Accordingly, in order to improve on the above-noted drawbacks associated with the prior art, it is an object of the present invention to provide a novel apparatus and a method for manufacturing a plasma display panel, whereby degassing is completed in a short amount of time, with a small amount of residual gas, this being achieved without an exhaust tube.

SUMMARY OF THE INVENTION

To achieve the above-noted object, the present invention has the following basic technical constitution.

Specifically, a first aspect of the present invention is an apparatus for manufacturing a plasma display panel comprising a joining chamber that forms a plasma display panel by joining a front substrate and a rear substrate by heating a low-melting-point glass and a gas introduction and sealing chamber which introduces a luminescent gas into the plasma display panel which is formed by the joining chamber via a gas introduction port provided in the front substrate or the rear substrate, and seals the gas introduction port, the manufacturing apparatus further comprising: a first mechanism for supplying a cover member formed by a metal sheet to which low-melting-point glass is applied to a first location within the gas introduction and sealing chamber, a second mechanism provided in the gas introduction and sealing chamber for moving the cover member from the first location to a second location which is over a heating apparatus, a third mechanism provided in the gas introduction and sealing chamber for performing vacuum exhausting an inside of the plasma display panel and introducing a luminescent gas into the plasma display panel, and a fourth mechanism provided in the gas introduction and sealing chamber for heating the metal sheet to which the low-melting-point glass is applied by using the heating apparatus, so that the gas introduction port is sealed by the low-melting-point glass.

In a second aspect of the present invention, a first member movable up and down disposed within the gas introduction and sealing chamber, and a second member movable up and down which is surrounded by the first member are provided, the fourth mechanism is provided on the second member, and the third mechanism is provided in the first member.

In a third aspect of the present invention, a plasma display panel in which the front substrate is fixed to the rear substrate is placed within the joining chamber, and the joining chamber is vacuum-exhausted and the front substrate and the rear substrate are joined by the low-melting-point glass.

In a fourth aspect of the present invention, the joining chamber and the gas introduction and sealing chamber are a single chamber.

In a fifth aspect of the present invention, a luminescent gas introduction system and a gas exhaust system are provided in the gas introduction and sealing chamber, and the luminescent gas introduction system and the gas exhaust system are communicating with the gas introduction/exhaust path provided inside the second member.

In a sixth aspect of the present invention, one end of the second member is brought into intimate contact with the plasma display panel.

A method for manufacturing a plasma display panel according to the present invention is a method for manufacturing a plasma display panel formed by heating a low-melting-point glass so as to join a front substrate to a rear substrate, after which a luminescent gas is introduced into the plasma display panel via a gas introduction port provided in either the front substrate or the rear substrate, after which the gas introduction port is sealed, the method comprising: a first step of fixing the front substrate of said plasma display panel to the rear substrates, placing the substrates into a joining chamber, and then performing vacuum exhausting an inside of the joining chamber, a second step of heating a sealing glass provided on the front substrate or the rear substrate, so as to join the front substrate to the rear substrate, a third step of placing the joined plasma display panel in a gas introduction and sealing chamber which has been vacuum-exhausted, and then vacuum exhausting an inside of the plasma display panel, a fourth step of making an inside of the gas introduction and sealing chamber an atmospheric pressure, a fifth step of introducing the luminescent gas into the plasma display panel which has been vacuum-exhausted, and a sixth step of sealing the gas introduction port of the plasma display panel.

In a second aspect of a manufacturing method according to the present invention, the sixth step comprising: a step of supplying a cover member formed by a metal sheet to which a low-melting-point glass is applied to a first location within the gas introduction and sealing chamber, a step of moving the cover member to a second location which is over a heating apparatus provided within the gas introduction and sealing chamber, and a step of pressing the metal sheet to which is applied a low-melting-point glass on the heating apparatus against the gas introduction port and sealing the gas introduction port.

DETAILED DESCRIPTION OF THE PREFERRED EMBODIMENTS

Figure 1:
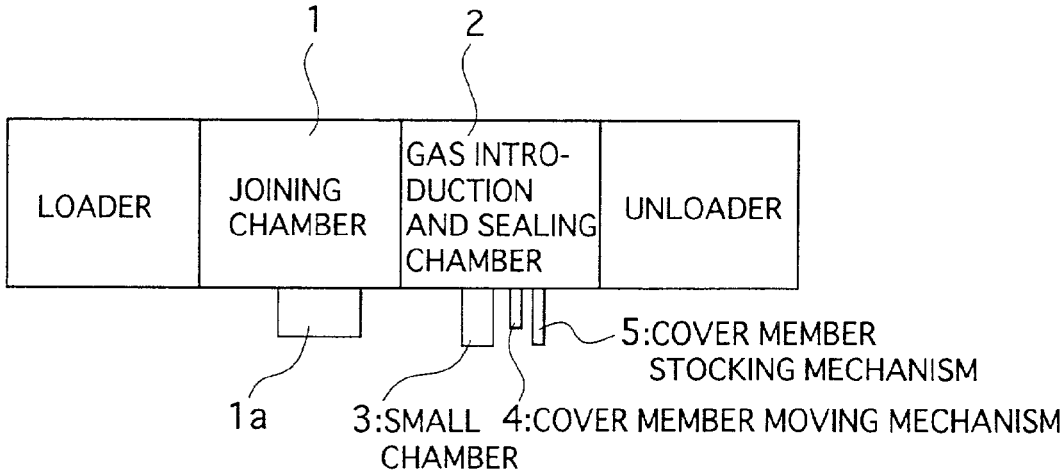
FIG. 1 is a drawing showing the configuration of an apparatus for manufacturing a plasma display panel according to the present invention.

Preferred embodiments of an apparatus and a method for manufacturing a plasma display panel are described in detail below, with references made to relevant accompanying drawings.

FIG. 1 to FIG. 5 illustrate an apparatus and a method for manufacturing a plasma display panel according to the present invention, these drawings showing an apparatus for manufacturing a plasma display panel, this apparatus having a joining chamber 1 in which the front and rear substrates are joined by heating a low-melting-point glass, thereby forming the plasma display panel, and a gas introduction and sealing chamber 2, in which a luminescent gas or discharge gas is introduced into the plasma display panel via a gas introduction port 13*a* provided in the front substrate or the rear substrate, after which the as introduction port is sealed.

In the gas introduction and sealing chamber 2, there is a first mechanism 5 for supplying a cover member 9 made of a metal sheet to which a low-melting-point glass is applied to a prescribed position P1 inside the gas introduction and sealing chamber 2, a second mechanism 4 for moving the cover member 9 from the prescribed position P1 to over a heating apparatus 8, a third mechanism 31 for vacuum exhausting the inside of the plasma display panel and then introducing a luminescent gas into the plasma display panel, and a fourth mechanism 41 for heating with the heating apparatus 8 the cover member 9 to which a low-melting-point glass is applied so as to seal the gas introduction port 13*a*.

A first up/down moving member 7 is provided inside a small chamber 3 provided within the gas introduction and sealing chamber 2, and a second up/down moving member 42 is provided so as to be surrounded within the first member 7, the fourth mechanism 41 being assembled with the second member 42, and the third mechanism 31 being assembled with the first member 7.

In the drawings, an apparatus for manufacturing a plasma display panel is shown, in which a plasma display panel with an assembled front substrate and rear substrate is placed inside the joining chamber 1, a vacuum exhausting mechanism 1*a* for vacuum exhausting within the joining chamber 1 being further provided.

The present invention is described below in further detail.

Figure 2:
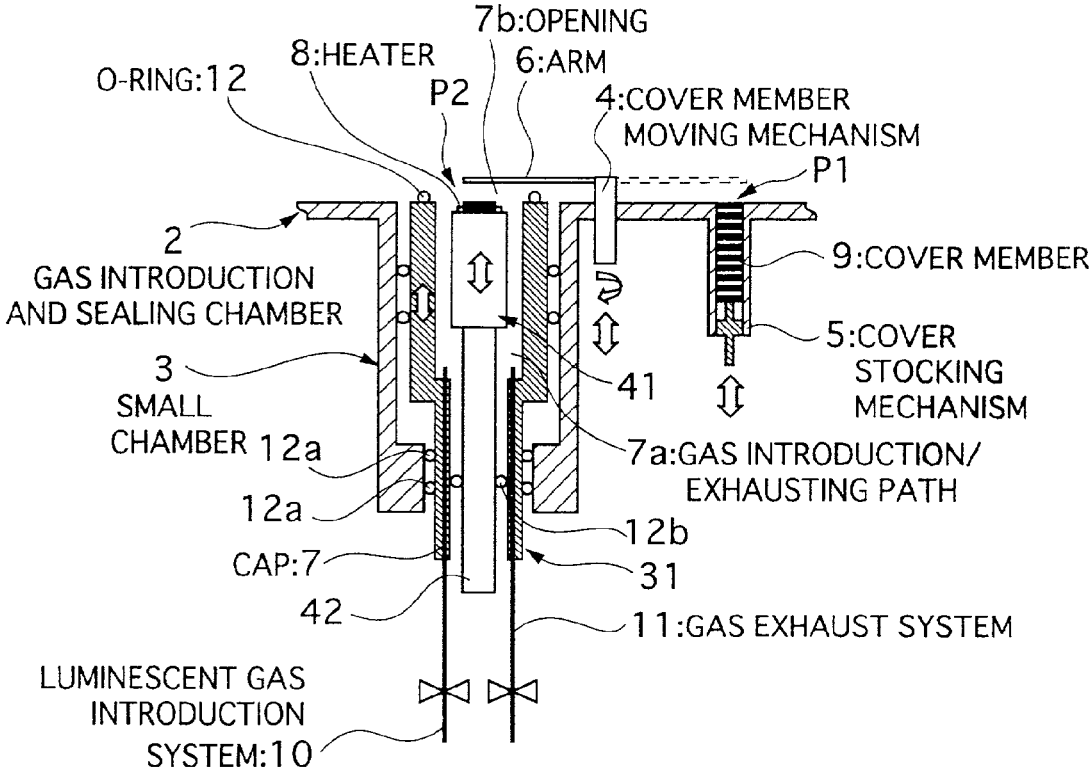
FIG. 2 is a cross-sectional view showing details of the configuration of a cover member stocking mechanism, cover member moving mechanism, a small chamber provided in the gas introduction and sealing chamber.
Figure 3:
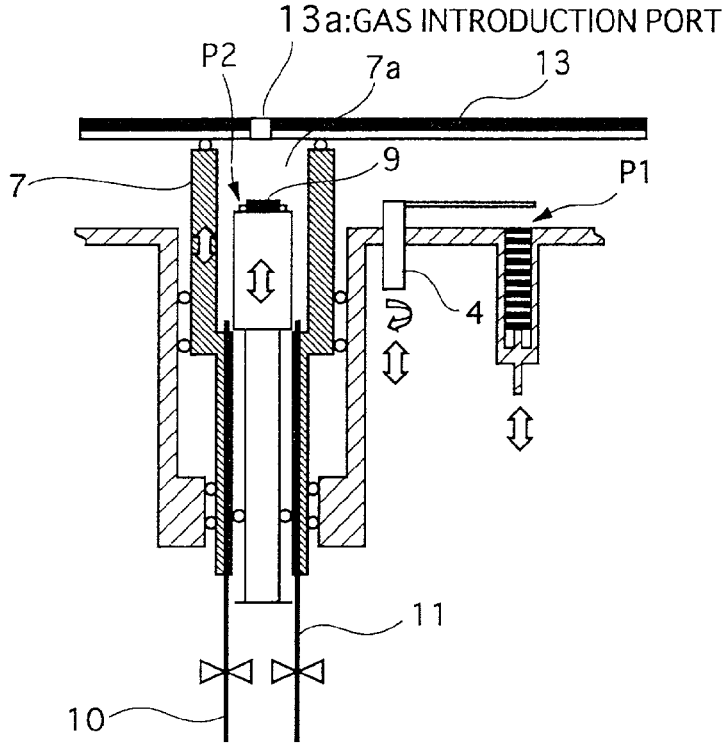
FIG. 3 is a drawing shown the condition in which the cap of the small chamber is brought into intimate contact with the plasma display panel, and the inside of the panel is exhausted or filled with a luminescent gas.
Figure 4:
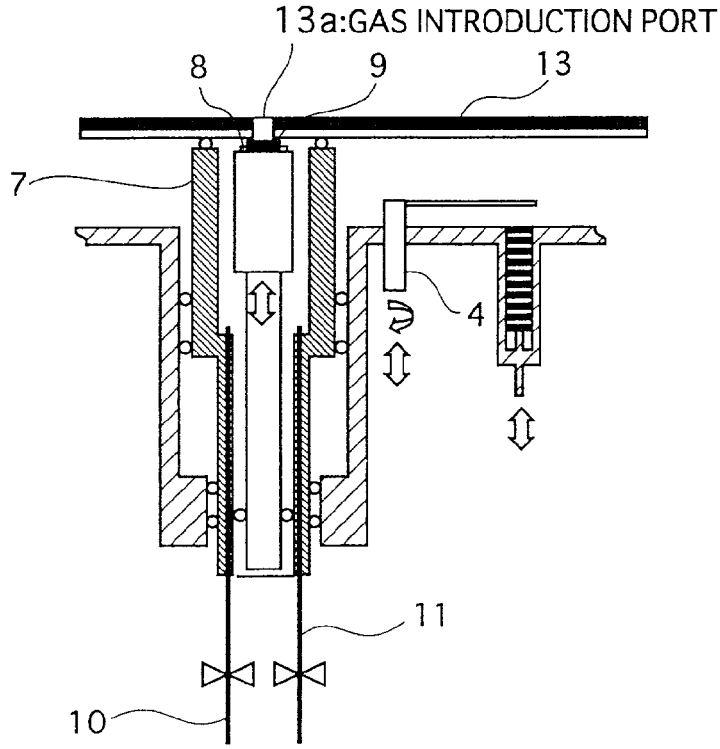
FIG. 4 is a drawing which shows the condition in which the heating apparatus in the small chamber is pushed up, a cover member is pushed up against the gas introduction port of the plasma display panel, and the gas introduction port is sealed.

FIG.1 shows the configuration of an apparatus for manufacturing a plasma display panel according to the present invention, FIG. 2 is an enlarged cross-sectional view showing the main part of the gas introduction and sealing chamber, FIG. 3 is a cross-sectional view showing the condition in which a cap is pushed upward, and the plasma display panel is vacuum exhausted or filled with a luminescent gas, and FIG. 4 is a drawing showing the condition in which a heater is pressed up against the gas introduction port of the plasma display panel.

As shown in FIG. 1, the gas introduction and sealing chamber 2 is provided next to the joining chamber 1, and a small chamber 3, a cover member moving mechanism 4, and a cover member stocking mechanism 5 are further provided within the gas introduction and sealing chamber 2.

The cover member stocking mechanism 5 is configured so that it constantly supplies a metal cover member 9 to the position P1 in the gas introduction and sealing chamber 2. The metal cover member 9 is formed of an iron-nickel-chromium alloy such as 426 alloy which is wet hydrogen processed to form a chrome-rich oxide film thereon, on one side of which a low-melting-point lead glass layer having a working temperature of 430° C. is applied and fused.

The cover member moving mechanism 4 moves a metal cover member 9 placed at the position P1 to a position P2 over a heater 8 provided in the small chamber 3, and has on its end a transporting arm 6 to which is mounted an electromagnet, the arm 6 being driven by an up/down rotating mechanism (not shown in the drawing).

A cylindrical exhausting/gas introduction member (hereinafter referred to as the cap) 7 that moves up and down is provided within the small chamber 3, and an O-ring 12 for providing an intimate contact between the end part of the cap 7 and the plasma display panel 13 is mounted on the end part of the cap 7. The luminescent gas introduction system 10 and the exhaust system 11 are provided, and the luminescent gas introduction system 10 and the exhaust system 11 are communicating with the gas introduction/exhaust path 7*a* provided inside the cap 7. The cap 7 is vacuum-sealed with respect to the outside atmosphere by an O-ring double seal 12*a* that is movable up and down.

A rod-shaped member 42 is provided inside the cap 7, the top part of this rod-shaped member 42 having a heater 8 mounted thereto, the rod-shaped member 42 being movable up and down, and vacuum sealed with respect to the outside atmosphere by an O-ring double seal 12*b*.

Figure 5:
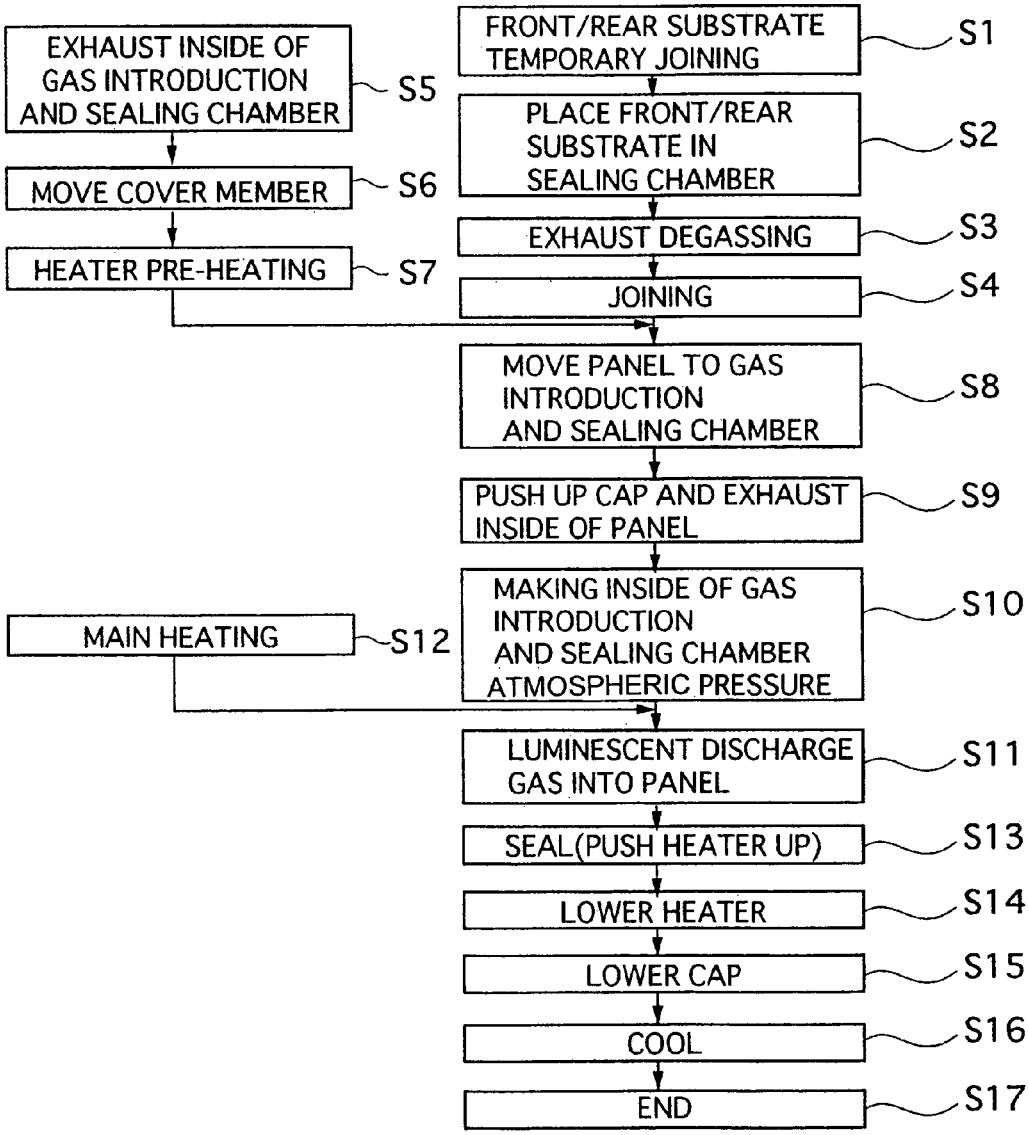
FIG. 5 is a flowchart showing the process steps of the present invention.

A method for manufacturing a plasma display panel according to the present invention is described below, with reference made to the FIG. 3, FIG. 4, and the flowchart of FIG. 5.

Similar to the case of a plasma display panel of the past, a transparent electrode, a bus electrode, a transparent dielectric layer, and a MgO protective layer and so forth are formed on the surface of the front substrate of the plasma display panel, and a data electrode, transparent dielectric layer, a separator, a phosphor layer, and a sealing glass layer and so forth are formed on the rear substrate thereof. A gas introduction port, which is a through hole for the purpose of exhaust gas release and introduction of a luminescent gas is additionally provided on the rear substrate.

The two substrates are assembled in mutual opposition and are temporarily held together using, for example, a fixture or clip (step S1). The temporarily joined substrates are placed in the joining chamber 1 shown in FIG. 1 (step S2), exhausting is done by an exhausting apparatus 1*a*, and gas is released and joining is performed, using a heater (not shown in the drawing) (steps S3 and S4). Simultaneously, the gas introduction and sealing chamber 2 shown in FIG. 1 is vacuum exhausted (step S5), a metal cover member 9 stocked in the cover member stocking mechanism 5 is moved to over the heater 8 by the cover member moving mechanism 4 (step S6), and pre-heating is done with the heater (step S7).

Next, the joined panel is moved from the joining chamber 1 to the gas introduction and sealing chamber 2 (step S8). When this is done, the gas introduction port of the rear substrate is positioned near the center line of the heater 8.

The cap 7 inside the small chamber 3 is pushed upward, bringing it into contact with the rear substrate 13, the exhaust system 11 continuing to exhaust the inside of the panel (step S8) and the gas introduction and sealing chamber 2 is leaked so as to be at atmospheric pressure (step S10). Next, the luminescent gas introduction system 10 introduces a luminescent gas mixture of argon (Ar), neon (Ne), and xenon (Xe), via the opening 7*b*, at a specified pressure of 53,200 to 79,800 Pa (400 to 600 Torr) (step S11). FIG. 3 shows the above noted condition in which a cap is pushed upward, and the plasma display panel is vacuum exhausted or filled with a luminescent gas.

Finally, as shown in FIG. 4, as the heater is heated (step S12), the heater 8 is pushed upward, so as to seal the gas introduction port of the rear substrate 13 with low-melting-point glass (step S13).

After the above, as shown in FIG. 3 the heater is lowered (step S14), the cap 7 being lowered and the gas introduction and sealing chamber 2 is leaked so as to be at atmospheric pressure (step S15). The panel is moved to an unloader, and cooled to below 100° C. (step S16), after which the plasma display panel is removed from the unloader (step S17).

Although the above description is for the case in which the joining chamber and the gas introduction and sealing chamber are separated in an in-line arrangement, it will be readily understood that a batch version of the method of the present invention, in which all steps are performed in a single chamber, can also be used.

By adopting the above-noted constitutions, an apparatus and a method for manufacturing a plasma display panel achieves the following effects.

Because heating and degassing is done within the joining chamber before the joining of the front and rear substrates, compared to the exhausting method of the past, in which exhausting was done via an exhaust tube, it is possible to complete the exhausting step in a short time, thereby enabling an improvement in productivity.

Additionally, because after completion of joining in the joining chamber there is continued exhausting within the gas introduction and sealing chamber, it is possible to quickly remove residual gas that remained within the panel at the time of panel joining, thereby enabling prevention of a worsening of the purity of the luminescent gas introduced into the panel. As a result, the panel luminescent gas characteristics are stabilized, and reliability is improved.

Additionally, because the luminescent gas is introduced into the panel via a luminescent gas introduction system provided in the small chamber, there is no need to fill a large-capacity vacuum chamber with the luminescent gas, thereby enabling a savings in the amount of high-cost luminescent gas used.

Because the gas introduction port is sealed by a low-melting-point glass and a metal sheet, there is no chip tube protrusion remaining on the panel, thereby solving the problems involved in handling the panel.

What is claimed is:

1. An apparatus for manufacturing a plasma display panel having an inside and comprising a joining chamber that forms a plasma display panel by joining a front substrate and a rear substrate by heating a low-melting-point glass and a gas introduction and sealing chamber which introduces a luminescent gas into said plasma display panel which is formed by said joining chamber via a gas introduction port provided in said front substrate or said rear substrate, and seals said gas introduction port, said manufacturing apparatus further comprising:

a first mechanism for supplying a cover member formed by a metal sheet to which low-melting-point glass is applied to a first location within said gas introduction and sealing chamber, a second mechanism provided in said gas introduction and sealing chamber for moving said cover member from said first location to a second location which is over a heating apparatus, a third mechanism provided in said gas introduction and sealing chamber for performing vacuum exhausting the inside of said plasma display panel and introducing a luminescent gas into said plasma display panel, and a fourth mechanism provided in said gas introduction and sealing chamber for heating said metal sheet to which said low-melting-point glass is applied by using said heating apparatus, so that said gas introduction port is sealed by said low-melting-point glass, wherein said third mechanism in said gas introduction and sealing chamber is adapted to perform vacuum exhausting, at least, before said fourth mechanism in said gas introduction and sealing chamber is used to melt said low-melting-point glass, wherein a first member movable up and down disposed within said gas introduction and sealing chamber, and a second member movable up and down which is surrounded by said first member are provided, said fourth mechanism is provided on said second member, and said third mechanism is provided in said first member.

2. An apparatus for manufacturing a plasma display panel according to claim 1, wherein a plasma display panel in which said front substrate is fixed to said rear substrate is placed within said joining chamber, and said joining chamber is vacuum-exhausted and said front substrate and said rear substrate are joined by said low-melting-point glass.

3. An apparatus for manufacturing a plasma display panel according to claim 1, wherein said joining chamber and said gas introduction and sealing chamber are a single chamber.

4. An apparatus for manufacturing a plasma display panel according to claim 1, wherein a luminescent gas introduction system and a gas exhaust system are provided in said gas introduction and sealing chamber, and said luminescent gas introduction system and said gas exhaust system are communicating with the gas introduction/exhaust path provided inside said second member.

5. An apparatus for manufacturing a plasma display panel according to claim 4, wherein one end of said second member is brought into intimate contact with said plasma display panel.

* * * * *